United States Patent [19]

Egener et al.

[11] 4,203,471

[45] May 20, 1980

[54] MONITORING DEVICE FOR STEAM-TURBINE VALVES

[75] Inventors: Ernst-Günter Egener; Wolfgang Kindermann, both of ülheim, Fed. Rep. of Germany

[73] Assignee: Kraftwerk Union Aktiengesellschaft, Mülheim an der Ruhr, Fed. Rep. of Germany

[21] Appl. No.: 934,675

[22] Filed: Aug. 18, 1978

[30] Foreign Application Priority Data

Aug. 23, 1977 [DE] Fed. Rep. of Germany ..... 2737969

[51] Int. Cl.[2] ..... F01D 17/24

[52] U.S. Cl. ..... 137/637; 60/660; 137/885

[58] Field of Search ..... 60/660; 415/13; 137/637, 885

[56] References Cited

FOREIGN PATENT DOCUMENTS 1426802 9/1976 Fed. Rep. of Germany .

*Primary Examiner*—Gerald A. Michalsky

*Attorney, Agent, or Firm*—Herbert L. Lerner

[57] ABSTRACT

Monitoring device for steam-turbine valves having respective electrohydraulic servocontrol devices for directly controlling the valves individually, including means for monitoring operability of the respective servocontrol devices, the operability monitoring means including means for comparing a value of a variable of each one of the servocontrol devices determining a setting of the respective valve with a mean value of corresponding variables of others of the servocontrol devices determining respective settings of valves associated with the other servocontrol devices and for establishing from the comparison if a permissible deviation from the mean value is exceeded by the variable value of the respective one of the servocontrol devices, and means for controlling a valve drive associated with the respective valve controlled by the respective one of the servocontrol devices for driving it in closing direction thereof when the permissible deviation from the mean value is exceeded.

6 Claims, 3 Drawing Figures

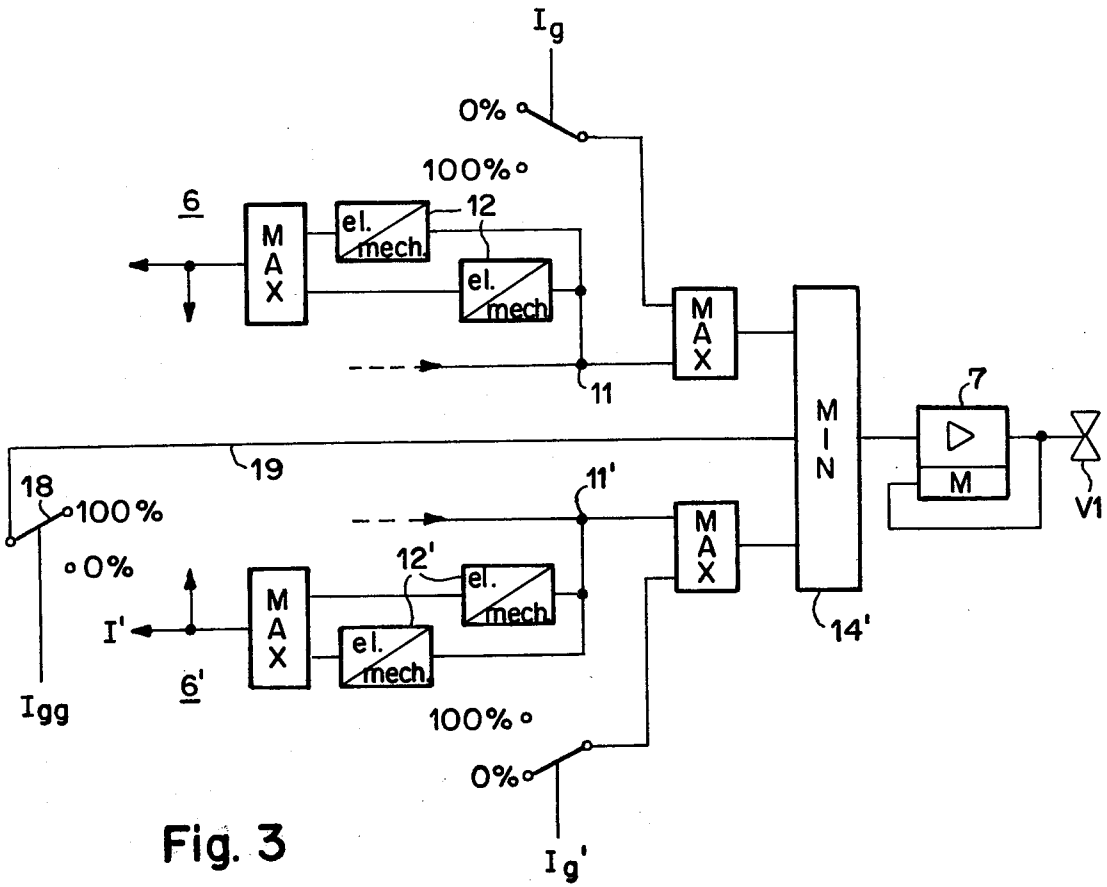
Fig. 3
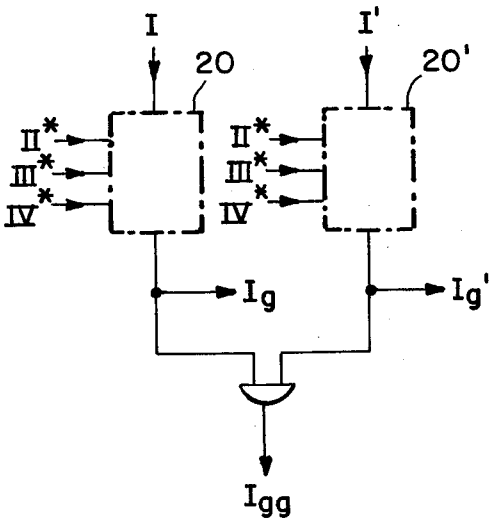

MONITORING DEVICE FOR STEAM-TURBINE VALVES

The invention relates to a monitoring device for steam turbine valves which are electrically addressed or controlled individually directly by an electro-hydraulic servocontrol device.

Such a servocontrol device with electrical addressing or control of the valves, wherein signal processing is effected exclusively by electrical means, and the hydraulic system is used for power amplification, is known from German Published Non-Prosecuted Application DE-OS No. 1,426,802 wherein monitoring and acknowledgment of the valve position or setting are effected by a position transmitter which directly furnishes an actual valve stroke signal. In addition to the considerable cost of such a circuit, however, monitoring of the valve position or setting and the valve control is not afforded, so that considerable secondary damage can occur in the event of a failure.

In view of this, it is an object of the invention to provide a monitoring device for such valves that are directly addressed or controlled electrically, which will improve considerably the reliability and availability of the entire control system and which will afford timely detection of any malfunctions thereof.

With the foregoing and other objects thereof, there is provided, in accordance with the invention, a monitoring device for steam-turbine valves having respective electrohydraulic servocontrol devices for directly controlling the valves individually, comprising means for monitoring operability of the respective servocontrol devices, the operability monitoring means including means for comparing a value of a variable of each one of the servocontrol devices determining a setting of the respective valve with a mean value of corresponding variables of others of the servocontrol devices determining respective settings of valves associated with the other servocontrol devices and for establishing from the comparison if a permissible deviation from the mean value is exceeded by the variable value of the respective one of the servocontrol devices, and means for controlling a valve drive associated with the respective valve controlled for the respective one of the servocontrol devices for driving it in closing direction thereof when the permissible deviation from the mean value is exceeded.

In accordance with another feature of the invention, the servocontrol devices include respective power pistons, and the power pistons have respective strokes, the lengths of the strokes being the respective variable values of the servocontrol devices determining the respective valve settings.

In accordance with a further feature of the invention, the monitoring device includes respective means in each of the servocontrol devices for converting the value of the respective power piston stroke into an electrical signal, the comparing and establishing means comprising a comparator having a first input for the electrical signal corresponding to the power piston stroke of the one servocontrol device and a second input for an electrical signal corresponding to the mean value of the power piston strokes of the other servocontrol devices, the comparator having an output, a limit switch connected to the output and actuatable when the permissible deviation from the mean value is exceeded by the value of the elctrical signal at the first input of the comparator, time delay means connected to the limit switch and a memory connected to the time delay means, the memory having an output connectible with the valve drive for controlling the same.

In accordance with an added feature of the invention, the monitoring device includes an additional hydraulic control line having a magnetic valve connected therein, the memory output being connectible to the magnetic valve, a minimum selector shunting the additional hydraulic control line across the respective electrohydraulic servocontrol device, the magnetic valve being operable in response to a signal from the memory output.

In accordance with an additional feature of the invention, two electrohydraulic servocontrol devices are associated with each of the valves and separate means for monitoring operability of the two servocontrol devices are associated with each valve respectively, and further included is a minimum selector through which the two servocontrol devices act upon the respective valve drive, at least one of the two servocontrol devices always remaining in controlling association with the valve drive.

In accordance with a concomitant feature of the invention, the monitoring device includes means for controlling the respective valve drive so as to drive the respective valve in closing direction thereof upon failure of both of the two electrohydraulic servocontrol devices associated with the respective valve.

Other features which are considered as characteristic for the invention are set forth in the appended claims. Although the invention is illustrated and described herein as embodied in monitoring device for steam turbine valves, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a block diagram similar to that of FIG. 2 of another embodiment of the monitoring circuit.

Figure 1:
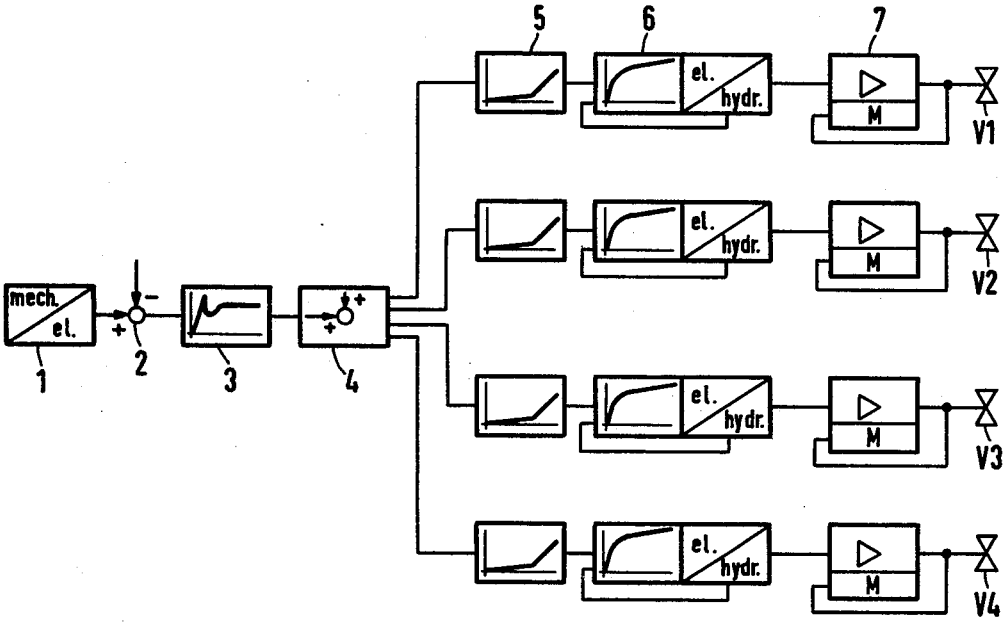
FIG. 1 is a block diagram of an overall control system for individually addressing or controlling a valve group electrically.

Referring now to the drawing and first, particularly, to FIG. 1 thereof, there is assumed in the basic presentation of the individual electrical addressing or control device that the respective valve group is made up of four live steam valves V1 to V4. This basic presentation applies equally also to intercept adjusting or positioning valves (Abfangstellklappen) in corresponding installations. In particular, the signal processing, namely the formation of the actual value 1, the comparison 2 between actual and reference values, the control 3, the grading or selective tripping 4 with subsequent signal distribution and formation of characteristic curves 5, is accomplished exclusively by electrical means. The signal thus formed for the individual valves V1 to V4 are subsequently fed to positioning circuits 6 for the servovalves i.e. to the electrohydraulic servocontrol associated with each valve V1 to V4. Thus, electrohydraulic conversion is effected decentralized for each valve positioning drive 7, which results in greater availability if one of the converters should fail.

In accordance with the invention, these electrohydraulic servocontrols 6 are then monitored for operability, as will be explained hereinafter in detail with reference to FIG. 2. First, only the monitoring of the servocircuit for the valve V1 will be considered.

The servo-valve 8 controls a flow-through of a control liquid which is proportional to the input signal from a valve-opening control 9 connected in advance thereof and makes a power piston 10 run in the one or the other direction, depending upon the sign (+ or −) of the signal. The position or setting of this power piston 10 is measured at a point 11 and, after a mechanical signal is converted in the converters 12 into an electrical signal, is fed as the value of the controlled variable to the input 13 of the opening control 9. If the electrohydraulic servocontrol functions properly, this power piston 10 then determines the drive position or setting for the valve V1. At a location ahead of the opening control input 13, a variable determining the valve position or setting, namely the stroke of the power piston 10, is picked up, moreover, as the signal I and fed to a failure monitoring circuit 20 per se. In this failure monitoring circuit 20, the signal I is compared in a comparator 21 with a value signal formed in a module 22 which is a mean value of the power piston position or setting signals II, III and IV of the other electrohydraulic servocontrols 15, 16 and 17 of the valves V2, V3 and V4, respectively. If the signal I i.e. the power piston position or setting in the electrohydraulic converter 6, deviates from the mean value of the other three signals II, III and IV in the direction of "valve opening", then the limit switch 23 following the comparator 21 is actuated first and, after the signal retained in a time delay member 24 so as to eliminate dynamic influences, a memory 25 is set, from which a signal $I_g$ i.e. "electrohydraulic servocontrol for valve V1 disturbed", is issued. This signal then adjusts the additional hydraulic servocontrol 19 to a setting 0% through a magnetic switch 18, the valve drive 7 being addressed or controlled in the closing direction through one input of a minimum selector 14, the other input of which is acted upon by the power piston 10.

Figure 2:
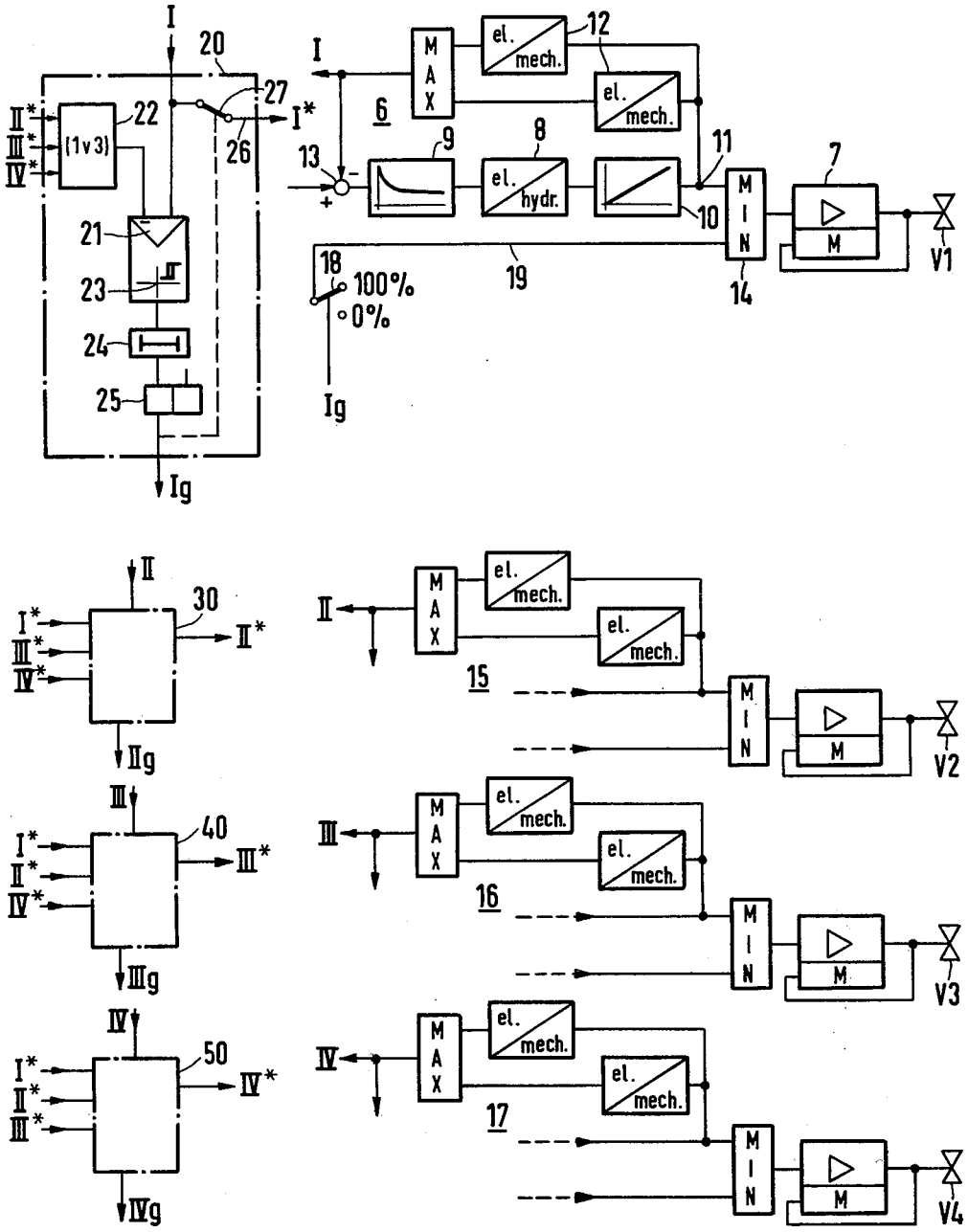
FIG. 2 is a block diagram for the monitoring circuit of the individual electrohydraulic servocontrols.

In a similar manner, the electrohydraulic servocontrols 15, 16 and 17 are monitored for operability in the respective failure monitoring circuits 30, 40 and 50, which are shown only symbolically with the inputs and outputs thereof in FIG. 2. The signals I*, II*, III* and IV*, from which the respective mean value is formed by cyclical commutation, are taken off at a separate output 26, as is shown by the failure monitoring circuit 20 for the signal I*. This output 26 can be interrupted by a switch 27 if a trouble signal $I_g$ is present, so that if, for example, the signal I* fails, the mean value in the failure monitoring circuits 30, 40 and 50 can then nevertheless be formed from only two signals of operable servocontrols. If the servocontrols 15, 16 or 17 do not work properly, then there is present in the respective failure monitoring circuits 30, 40 and 50 likewise a trouble signal $II_g$, $III_g$ or $IV_g$, with which the valves V2, V3 or V4 can be driven into the valve closing position through the respective additional hydraulic servocontrols.

For additionally increasing the availability, it is furthermore possible to equip each valve drive with two electrohydraulic servocontrols, such as is provided by the embodiment of FIG. 3, each of the two servocontrols, which act on the valve drive through a minimum selector, being monitored separately and being disconnected or switched off in case of a fault, in such a manner that the sound or healthy servocontrol always remains engaged. Like parts in FIGS. 2 and 3 are identified by the same or primed reference numerals. Only in the event of a fault occurring sequentially as to time in both servocontrols is the respective valve drive then addressed or controlled so as to actuate the valve into closing position or setting.

There are claimed:

1. Monitoring device for steam-turbine valves having respective electrohydraulic servocontrol devices for directly controlling the valves individually, comprising means for monitoring operability of the respective servocontrol devices, said operability monitoring means including means for comparing a value of a variable of each one of the servocontrol devices determining a setting of the respective valve with a mean value of corresponding variables of others of the servocontrol devices determining respective settings of valves associated with the other servocontrol devices and for establishing from the comparison if a permissible deviation from said mean value is exceeded by said variable value of the respective one of the servocontrol devices, and means for controlling a valve drive associated with the respective valve controlled by the respective one of the servocontrol devices for driving it in closing direction thereof when said permissible deviation from said mean value is exceeded.

2. Monitoring device according to claim 1 wherein the servocontrol devices include respective power pistons, and said power pistons have respective strokes, the lengths of said strokes being the respective variable values of the servocontrol devices determining the respective valve settings.

3. Monitoring device according to claim 2 including respective means in each of the servocontrol devices for converting the value of the respective power piston stroke into an electrical signal, said comparing and establishing means comprising a comparator having a first input for the electrical signal corresponding to the power piston stroke of the one servocontrol device and a second input for an electrical signal corresponding to the mean value of the power piston strokes of the other servocontrol devices, said comparator having an output, a limit switch connected to said output and actuatable when the permissible deviation from said mean value is exceeded by the value of the electrical signal at said first input of said comparator, time delay means connected to said limit switch and a memory connected to said time delay means, said memory having an output connectible with the valve drive for controlling the same.

4. Monitoring device according to claim 3 including an additional hydraulic control line having a magnetic valve connected therein, said memory output being connectible to said magnetic valve, a minimum selector shunting said additional hydraulic control line across the respective electrohydraulic servocontrol device, said magnetic valve being openable in response to a signal from said memory output.

5. Monitoring device according to claim 4 wherein two electrohydraulic servocontrol devices are associated with each of the valves, and wherein separate means for monitoring operability of said two servocontrol devices associated with each valve, respectively, are provided, and including a minimum selector through which said two servocontrol devices act upon the respective valve drive, at least one of said two servocontrol devices always remaining in controlling association with the valve drive.

6. Monitoring device according to claim 5, including means for controlling the respective valve drive so as to drive the respective valve in closing direction thereof upon failure of both of the two electrohydraulic servocontrol devices associated with the respective valve.

* * * * *